US007762506B2

(12) United States Patent
Beshore

(10) Patent No.: US 7,762,506 B2
(45) Date of Patent: Jul. 27, 2010

(54) GLIDE DEVICE AND ARTICLE OF FURNITURE INCORPORATING THE SAME

(75) Inventor: Burrus D. Beshore, Sedalia, CO (US)

(73) Assignee: Max-Tech Products, Inc., Englewood, CO (US)

( * ) Notice: Subject to any disclaimer, the term of this patent is extended or adjusted under 35 U.S.C. 154(b) by 872 days.

(21) Appl. No.: 11/531,494

(22) Filed: Sep. 13, 2006

(65) Prior Publication Data

US 2007/0089266 A1 Apr. 26, 2007

Related U.S. Application Data

(63) Continuation-in-part of application No. PCT/US2005/006442, filed on Mar. 1, 2005.

(51) Int. Cl.
*A47B 91/02* (2006.01)

(52) U.S. Cl. ..... 248/188.9; 248/188.8; 248/615; 16/42 T; 411/510

(58) Field of Classification Search ..... 248/188.9, 248/346.11, 677, 188.8, 615; 16/42 R, 42 T; 411/509, 510
See application file for complete search history.

(56) References Cited

U.S. PATENT DOCUMENTS 780,684 A * 1/1905 Pratt ..... 248/188.9
1,123,959 A * 1/1915 Von Der Lin ..... 248/188.4
1,891,643 A * 12/1932 Henrikson ..... 16/42 R
3,025,631 A 3/1962 Reynolds
3,080,601 A * 3/1963 Kramcsak, Jr. ..... 16/42 R
3,311,338 A 3/1967 Culley
3,326,508 A 6/1967 Born
3,494,244 A * 2/1970 Wayland ..... 411/510
3,592,423 A 7/1971 Mui
3,646,633 A 3/1972 Meinhardt
3,810,279 A * 5/1974 Swick et al. ..... 411/509
4,368,864 A 1/1983 Tobey
4,717,301 A 1/1988 Oddenino
4,798,359 A 1/1989 Ball
4,923,158 A * 5/1990 Saisho ..... 248/188.8
4,993,903 A 2/1991 Kraus
5,088,669 A * 2/1992 Zinnbauer ..... 248/188.9
5,165,636 A * 11/1992 Grissom ..... 248/188.3
5,170,972 A * 12/1992 Casals Guell ..... 248/188.9
5,653,410 A 8/1997 Stroeters et al.
5,680,673 A 10/1997 Beshore
6,027,086 A * 2/2000 Heitlinger et al. ..... 248/188.5
6,324,725 B1 * 12/2001 Green ..... 16/42 R
6,478,270 B2 * 11/2002 Parisi et al. ..... 248/188.8
6,520,459 B2 2/2003 Burr
6,623,082 B1 * 9/2003 Huang ..... 297/463.1
6,742,750 B2 6/2004 Burr
6,915,993 B2 * 7/2005 O'Leary ..... 248/188.9
7,431,249 B2 * 10/2008 Hornberger ..... 248/188.9

* cited by examiner

*Primary Examiner*—Anita M King
(74) *Attorney, Agent, or Firm*—Holland & Hart LLP

(57) ABSTRACT

Provided is a glide device for use in stabilizing an object on a support surface. In one embodiment, the glide device is adapted to be mounted between the contact surface and the object and includes a stabilizer, which has opposed first and second surfaces and a body extending therebetween. The stabilizer is mounted to the object with a fastener that includes an elongate shank and at least one lug projecting away from the shank.

17 Claims, 4 Drawing Sheets

GLIDE DEVICE AND ARTICLE OF FURNITURE INCORPORATING THE SAME

BACKGROUND

Furniture is manufactured in a variety of different styles and configurations—many of which are functional, but others of which are primarily decorative. Certain types of furniture such as chairs, tables, desks, bar stools and the like, include a plurality of legs that normally engage a surface in order to support the furniture thereon. Legged articles of furniture such as these are prevalent and manufacturers attract consumers by constructing them in a variety of appealing designs and configurations.

Furniture is generally designed to be a durable commodity such that its owner may enjoy a significant lifetime of use. However, it is often the case—whether due to manufacturing defects, climactic changes, wear and tear or otherwise—that legged articles of furniture in particular can become improperly balanced on their support surfaces. Furniture without legs can also become unstable on a surface. The classic example is a wobbly table that annoys those seated around it and sometimes results in a spilled beverage. The unfortunate results of unstable furniture can range from inadvertent damage to objects placed on the furniture to injuries as a result of, for example, an unstable patron falling off an unstable bar stool.

Also of concern is the need to avoid damage or abrasion to the surfaces on, or against which, objects are placed. For legged objects, such as indoor furniture, the surface is typically carpeting, wooden floors, or tiled floors. For outdoor items, such as patio furniture, the support surface may be concrete, brick, tile, decking, or the like. Regardless of the surface encountered, one runs the risk that manufacturing imperfections may scratch, tear or otherwise damage the surface. Similar damage may occur when the furniture shifts or slides across the surface. This is especially problematic for furniture provided with a protective cap or glide device that subsequently falls off of the furniture exposing sharp edges.

In an effort to alleviate these problems, several types of protective devices have been developed. For furniture which is not ordinarily moved, it is common to place a shim(s) or its equivalent under its base (e.g., under one or more of the support legs) in order to balance the furniture on the support surface. For legged items, glide devices have also been used as a means for stabilizing furniture. For example, iron patio furniture is often equipped at the factory with a glide housing in the form of an inverted metal cup that is welded to the distal end of each support leg. The glides themselves are affixed by radial compression and friction to the interior walls of the inverted metal cups. However, as a result of manufacturing tolerances in the furniture or uneven support surfaces, these glides are not always effective at adequately addressing the aforementioned concerns. Similarly, cast iron patio furniture is often equipped with a rivet like insert that is pressed into a hole cast into the leg or base of the furniture. Again, due to wear and tear and manufacturing tolerances one or more of these inserts can fall out, causing damage to the support surfaces and destabilizing the furniture.

One particular glide device that has been widely used is a cup-like structure formed of a plastic material having an open mouth region received in the confines of the inverted metal cup. The base end of the glide device rests on the support surface when in the mounted state. With this type of construction the glide device tends to assume the orientation of the inverted metal housing. Another problem with this type of glide is the tendency of its sidewalls to fatigue over time. Eventually, the sidewalls become unable to withstand continued compressive loads and crack, perhaps causing further damage. Also, when used on uneven flooring, plastic cup glides can become distorted and grind into and scratch the support surface. Thus, even though the glide may be temporarily protecting the furniture, it is not protecting its environment.

My U.S. Pat. No. 5,680,673 addresses such problems by providing an improved glide device for stabilizing legged articles of furniture, while avoiding unnecessary damage to either the support surface or the furniture. To this end, the protective glide device is situated between the support surface and a foot portion of a legged object. The device incorporates a non-abrasive unitary body that is of sufficient thickness to withstand compressive forces of the legged object against the surface, thereby resisting collapse. The unitary body is mountable to the foot portion and has a lower area operative to contact the support surface and an upper area opposite the lower area that is in facing relationship to the foot portion when mounted. Preferably, a resilient member is interposed between the foot portion and the unitary body and operates to conform to contours on a contact surface of the foot portion to stabilize the support leg. Glide devices utilizing the resilient member have enjoyed much success in the marketplace and have proven to be quite effective at protecting furniture legs and support surfaces. In particular these devices offer stabilization and "self-leveling" characteristics, while additionally providing suitable wear resistance. With the variety of different types of furniture there is, however, an area in need of improvement relating to glide devices.

Attachment of a glide device, in many cases, including those described in my earlier patent, can be accomplished with double sided tape, but a more robust mounting method is via a fastener (typically a screw) that is used separately or in conjunction with adhesive means. Some furniture is provided with a mounting cavity or threaded bore for receiving a screw fastener in its base or legs, while other fasteners are self-tapping. In some instances there is not a threaded fastener but a rivet-like insert pressed into a hole formed in the leg or base. With the untold number of different furniture manufacturers there is an even greater variety in sizes and types of these mounting cavities. Given the variety of mounting cavities it is often difficult to determine and procure the correct size and type of mounting fastener. Described herein is a glide device that can be conveniently mounted to a variety of different sizes and types of mounting cavity.

SUMMARY

Provided is a glide device that is mountable between a contact surface and an object. The glide device summarized below is useful for resisting an object from marring the contact surface upon which it sits. In general the object could be an article of furniture such as a chair, a bar stool, patio furniture, or even a couch. In such cases the contact surface to be protected would be any type of flooring such as hard wood floors, tile, or carpet.

The glide device disclosed herein is also operative to stabilize an article of furniture or object on an uneven surface. For instance the disclosed glide device used on a bar stool will resist marring of a hardwood floor while at the same time stabilizing the bar stool in the event that the hardwood floor is uneven or the bar stool itself is unsteady. The glide device is comprised of a stabilizer, which includes opposed first and second surfaces and a body extending between those surfaces. A fastener is also included for mounting the stabilizer to the object. Preferably the fastener includes an elongate shank and at least one lug that projects away from the shank. In the preferred embodiment of the glide device the stabilizer may include a housing mountable to the object or article of furniture. The stabilizer body is configured to be at least partially received within the housing when it is in an assembled state. The stabilizer might further include a resilient member that interfaces between the body and the housing when in an assembled state. The stabilizer may include an opening through which the shank of the fastener can extend. Alternatively, the stabilizer and fastener may be of an integrally molded plastic construction. In either case it is preferable that the stabilizer and fastener are of molded construction.

Whether or not the fastener is integrally molded or inserted through an opening in the stabilizer, the fastener is sized such that it can be inserted into a mounting cavity formed in the object or article of furniture. In one embodiment the fastener includes at least one lug, which upon insertion into the mounting cavity would provide traction against an inner surface of the mounting cavity in order to resist subsequent removal of the stabilizer from the object or article of furniture. The fastener shank extends along a shank axis. In one embodiment the lugs of the fastener are of an annular configuration and are disposed about the shank in an axially spaced relationship to one another. Alternatively the lugs are configured as a plurality of fins equiangularly spaced about the shank axis.

In another embodiment, the fastener may be a friction fit fastener. In addition, the friction fit fastener may be formed with a cavity extending along the shank axis that is configured to receive an expander. Upon assembling the expander into the fastener cavity the fastener shank expands to provide additional friction to resist removal of the fastener, and consequently the stabilizer, from the object or article of furniture.

Also contemplated is an object, which is adapted to be stabilized on a support surface that includes a base portion with at least one mounting cavity. The object also includes at least one glide device mounted to the base portion. The glide device includes a stabilizer that is interposed in a mounted state between the base portion and the support surface. The stabilizer includes opposed first and second surfaces that respectively face the base portion of the object and the support surface with the body extending between the first and second surfaces. The glide device also includes a fastener for mounting the stabilizer to the base portion. The object may be any article with a base portion and at least one mounting cavity. For instance the object could be a chair, a bar stool or a table.

The object may also be an article of furniture with a plurality of legs that extend downwardly from a working surface and also includes a foot portion provided with a mounting cavity. On the article of furniture, a glide device may be associated with each foot portion that includes a stabilizer and a fastener for mounting the stabilizer to the foot portion. In one embodiment of the article of furniture the foot portion may be constructed of cast metal such as is typical of patio furniture. One type of such patio furniture is known in the industry as "garden" furniture and is usually constructed from cast iron. Another type of metal patio furniture is known as "casual" patio furniture, which is usually constructed of cast aluminum. Patio furniture is described herein for illustrative purposes only and the applicability of the present glide device is not limited to any particular type of object or article of furniture, since any suitably constructed object is contemplated.

Also provided is an improvement to an article of furniture including a plurality of legs each of which has a foot portion and a stabilizer fastened thereto by a fastener that includes a shank extending into a mounting cavity formed in the foot portion. The improvement is comprised of forming at least one lug integrally with the shank of the fastener which projects away from the shank to provide traction against an inner surface of the mounting cavity in order to resist subsequent removal of the stabilizer from the foot portion of the article of furniture. Again, the fastener may be constructed of a plurality of annular lugs spaced axially along the shank or may be comprised of a plurality of fins spaced equiangularly about the shank.

Also contemplated is a glide device kit for use with an object that is to be stabilized against a contact surface. The kit is comprised of at least one stabilizer that is interposable in a mounted state between the object and the contact surface. Also included in the kit is a plurality of differently configured fasteners each for mounting an associated stabilizer to the object. These fasteners are insertable through at least a portion of the body construction in order to mount the stabilizer to the object to define the mounted state. At least one of the fasteners includes a shank extending around a shank axis and a lug projecting away from the shank which is adapted for insertion into its associated mounting cavity to provide traction against an inner surface of the mounting cavity thereby to resist subsequent removal of the stabilizer from the front portion.

It should also be understood that a method is disclosed for stabilizing an object against a contact surface where the object has a mounting portion provided with a mounting cavity that extends axially into the mounting portion of the object. The method is comprised of providing a glide device that includes a stabilizer and a fastener for mounting the glide device to a mounting portion by axially urging the shank of the fastener into the mounting cavity until the lug engages an inner surface of the mounting cavity thereby providing traction against the inner surface to resist removal of the stabilizer from the foot portion.

DETAILED DESCRIPTION

Figure 1:
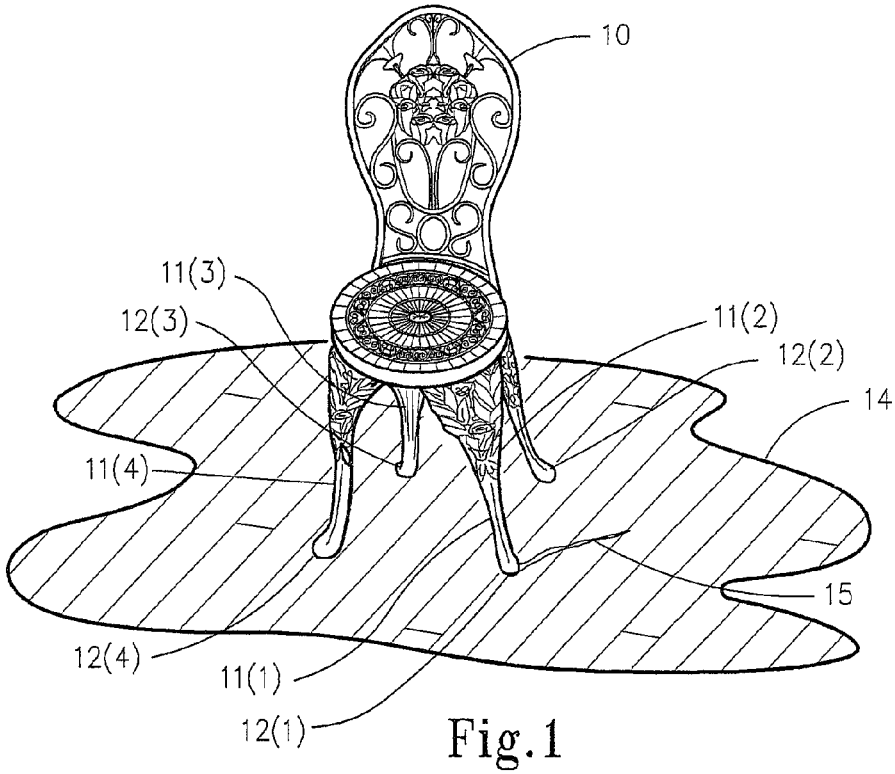
FIG. 1 is a perspective view illustrating an article of furniture resting on a support surface in different load-bearing orientations.

FIG. 1 illustrates an article of furniture 10 resting upon a support surface 14. In this particular case the article of furniture 10 is a chair constructed of cast iron and is typically referred to as garden furniture. Chair 10 includes a plurality of legs 11(1)-11(4) and a foot portion 12(1)-12(4), respectively, associated with each leg. FIG. 1 also shows that chair 10 has damaged support surface 14 in the form of a gouge 15. There are various types of flooring that are susceptible to this type of damage such as linoleum, wood decking, carpet, tile, and as in this case hardwood floors. FIG. 1 also illustrates that chair 10 is in an unstable condition. This condition may be caused either by an uneven support surface 14 or by manufacturing tolerances in the furniture 10. Instability of furniture and damage to support surfaces are problems that are common to many types of furniture, which can minimally result in an uncomfortable sitting environment.

To address this problem, provided is a first embodiment of a glide device 20 (FIG. 2) that is interposable between the foot portion 12 of the article of furniture 10 and support surface 14. The glide device 20 prevents damage to the support surface 14 while stabilizing otherwise unsteady furniture.

Figure 2:
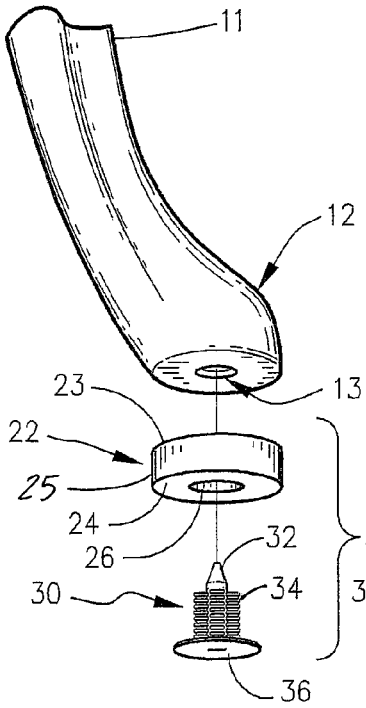
FIG. 2 is an exploded view of one exemplary embodiment of a glide device mounted to the foot portion of a representative leg of the article of furniture in FIG. 1.
Figure 4:
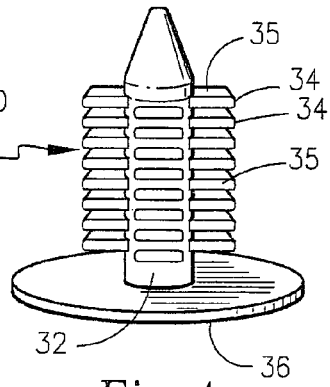
FIG. 4 is an enlarged view of the mounting fastener for use in the embodiments shown in FIGS. 2 and 3.
Figure 5A:
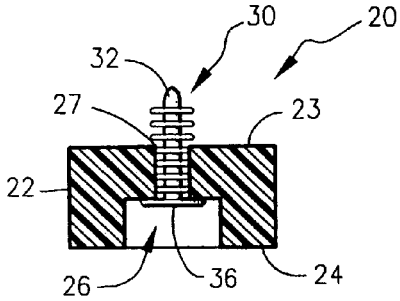
FIG. 5A is a partial cross-sectional view of the glide device introduced in FIG. 2 and showing it in an assembled state.
Figure 5B:
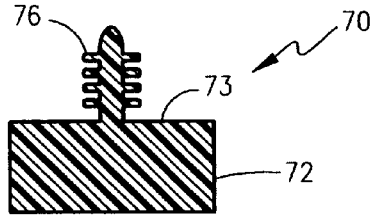
FIG. 5B is a cross-sectional view of yet another embodiment of a glide device having an integral fastener.

As can be seen in FIG. 2 glide device 20 generally consists of a stabilizer 22 and a fastener 30. In this embodiment, stabilizer 22 includes first and second opposed surfaces (23 and 24) and a body 25 extending therebetween. As shown in FIG. 4, fastener 30 includes an elongate shank 32 and at least one lug 34 extending away from shank 32. Also in this case, fastener 30 includes a head 36. With reference to FIG. 5A, stabilizer 22 is mounted to foot portion 12 by inserting elongate shank 32 through counter-bore 26 and through-hole 27 formed in stabilizer 22. The shank 32 thereby projects beyond first surface 23 and is insertable into mounting cavity 13, which is formed into the foot portion 12 of chair 10. Lug(s) 34 project away from shank 32 such that they engage the interior surface of mounting cavity 13 thereby resisting removal of the fastener 30. Meanwhile, head 36, being of a diameter larger than through-hole 27, retains stabilizer 22 on foot portion 12. It should be noted that fastener 30 may be a separate piece that is inserted through hole 27, as shown in FIG. 5A, or alternatively, the fastener 76 may be integrally molded with the stabilizer 72 as shown in FIG. 5B.

Figure 3:
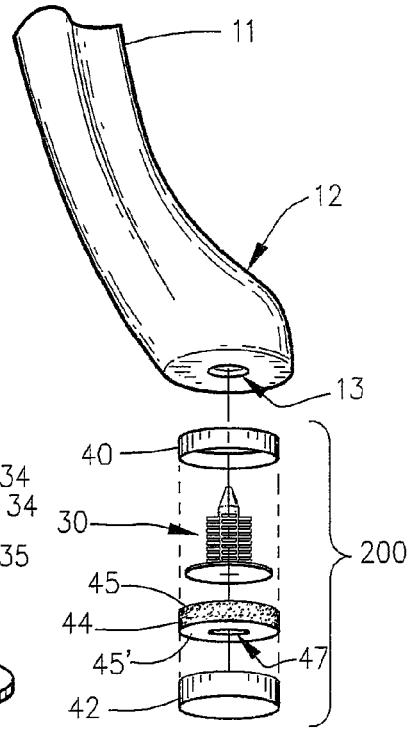
FIG. 3 is an exploded view of another exemplary embodiment of a glide device mounted to the foot portion of a representative leg of the article of furniture in FIG. 1.
Figure 6:
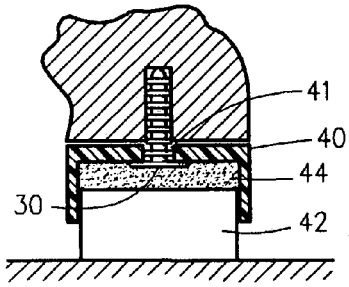
FIG. 6 is a partial cross-sectional view of the glide device, of FIG. 3, when in a mounted state on the leg's foot portion.

FIG. 3 illustrates an alternative embodiment of the glide device 200. With exception of the fastener, the glide device according to this embodiment is similar to those described in my earlier U.S. Pat. No. 5,680,673, the disclosure of which is hereby incorporated fully by reference. In this embodiment the stabilizer consists of housing 40, a body 42, and a resilient member 44, which interfaces the body to the housing. With particular reference to FIGS. 3 and 6, fastener 30 mounts housing 40 to foot portion 12 by inserting shank 32 through hole 41 and into mounting cavity 13. Resilient member 44 preferably includes a mounting adhesive on surfaces 45 and 45'. The resilient member may or may not provide a clearance hole 47 to accommodate head 36. It can be seen in FIG. 6 that resilient member 44 is sized and configured to fit within housing 40. Similarly, body 42 is sized and configured to fit partially within housing 40. By fitting body 42 partially within housing 40 any shear forces imparted to the body 42 are transferred directly to housing 40 rather than through resilient member 44.

As discussed in my co-pending International Application PCT/US 05/06442, filed Mar. 1, 2005, the disclosure of which is hereby incorporated fully by reference, housing 40 is preferably fabricated as an injection molded piece out of a suitable plastic construction, such as Acrylonitrile-Butadiene-Styrene (ABS). Body 42 is preferably formed from a non-abrasive plastic material such as acetyl resin to avoid unnecessary damage to the support surface during use. Such a material is available under the name DELRIN® from E.I. Dupont De Nemours and Co. Resilient member 44 is preferably formed of a pure polymer, closed-cell rubber material such as ethylene propylene diene methylene (EPDM), rather than a blended material. The rubber material has a maximum compression set recovery measurement of 35% (meeting the Suffix B3 requirement) when subjected to a compression set test conducted in accordance with specification D 1056-00 of the American Society for Testing and Materials (ASTM). This specification covers flexible cellular rubber products known as sponge rubbers and expanded rubbers. It is designed to provide certain physical property parameters and test methods for cellular rubber. The compression set test in particular tests the amount, measured in percentage, by which a standard rubber test piece fails to return to its original thickness after being subjected to a standard compressive load or deflection for a fixed period of time. This test is used to determine the quality of rubber compounds and their applicability to certain types of usage. Thus, if a material has good compression set resistance, it will recover sufficiently when the load is released. From a performance standpoint, it is even more preferred that the rubber material have a maximum compression set recover measurement of 25%, thus meeting the Suffix B2 requirement of ASTM D 1056.

It is also preferred that the rubber material be classified as either an ASTM D 1056 2A1 or 2A2 material. This classification contemplates closed-cell rubber (Type 2) in which specific resistance to the action of petroleum based oils is not required (Class A), and with the material having a compression-deflection range from either 2 to 5 psi (Grade 1) or 5 to 9 psi (Grade 2). There are various types of pure EPDM rubber materials which exhibit one or more of these characteristics, such as part numbers 4235-E, 4114-E and 4115-E available from American National Rubber of Ceredo, W. Va.

Figure 7A:
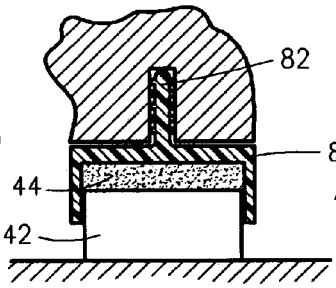
FIG. 7A is a partial cross-sectional view of a mounted glide device similar to that of FIG. 6, where the fastener is integral to the housing.
Figure 7B:
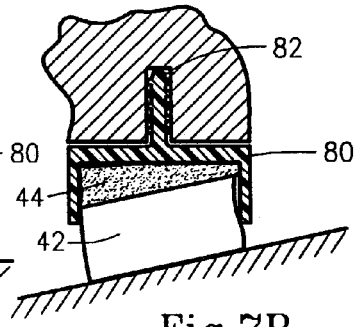
FIG. 7B is a partial cross-sectional view of the mounted glide device as introduced in FIG. 7A that illustrates the self-leveling capability of the design.

FIG. 7A illustrates an embodiment where fastener 82 is integrally molded with housing 80. It should be noted that in FIG. 7A the glide device is depicted as resting on a flat surface. In contrast, as is illustrated in FIG. 7B, the chair and its associated glide devices are resting upon an uneven surface. In this case the resilient member 44 deforms to allow body 42 to rest evenly on support surface 14. Accordingly, housing 80 and body 42 are preferably sized relative to each other to allow body 42 to adjust to the angle of the support surface 14. To further illustrate the stabilizing utility, it should be understood that on an article of furniture with a plurality of legs, each with an associated glide device, that the resilient member of each glide device can deform varying amounts to compensate for differences in the lengths of the legs or surface contours, thereby putting the article in a stabile equilibrium state. The glide devices as illustrated and described herein have been generally depicted as cylindrical in configuration. However, the glide device may be any suitable geometry such as a square or triangular configuration, to name a few.

Figure 8A:
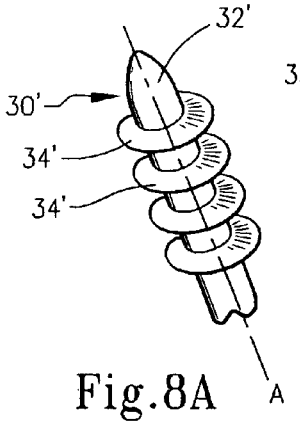
FIG. 8A is a partial perspective view that shows an alternative construction of the shank portion of a mounting fastener where each lug is comprised of a plurality of fins.
Figure 8B:
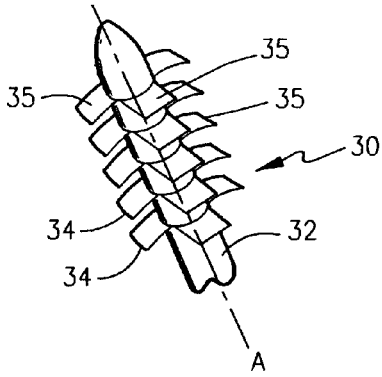
FIG. 8B is partial perspective view that shows one construction of the shank portion of a mounting fastener with annular lugs.

Turning now to the detailed construction of the fastener, FIG. 8B shows the shank 32 extending along shank axis "A". In this case each lug 34 is comprised of a plurality of fins 35 equiangularly spaced about said shank axis, with the lugs being disposed about said shank axis in axially spaced relation to one another. FIG. 8B contemplates 4 fins spaced at 90 degrees to each other. Other configurations could also be suitable, such as 3 fins spaced at 120 degrees or 2 fins spaced at 180 degrees. Furthermore, the shank 32 and the fins 35 do not necessarily have to be of cylindrical arrangement. The fastener may be of any geometric configuration such as for example square, octagonal, or triangular. FIG. 8A illustrates an alternative construction of the fastener where the shank portion 32' of a fastener 30' extends along a shank axis "A". In this embodiment, lugs 34' are each annular in configuration and are disposed about the shank axis "A" in axially spaced relation to one another.

Figure 9:
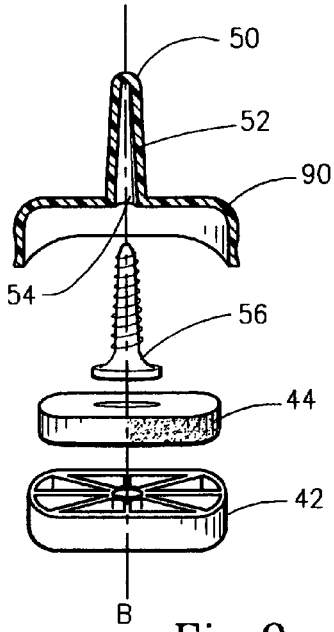
FIG. 9 is an exploded perspective view in partial cross-section of still another embodiment of a glide device that has an integrally molded friction fit fastener with an expander.
Figure 11:
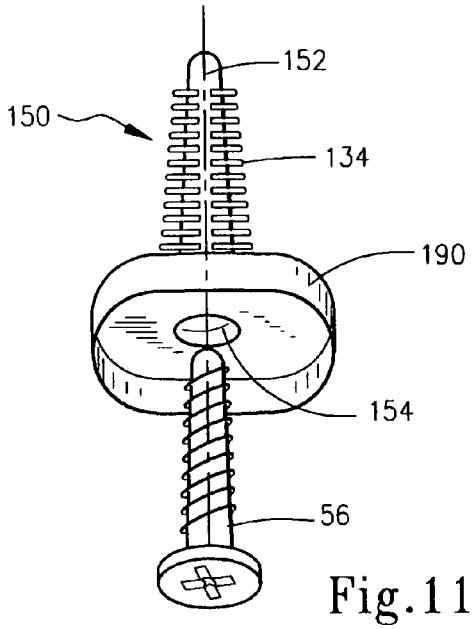
FIG. 11 is a perspective view of the integrally molded housing and lugged fastener as shown in FIG. 10.
Figure 10:
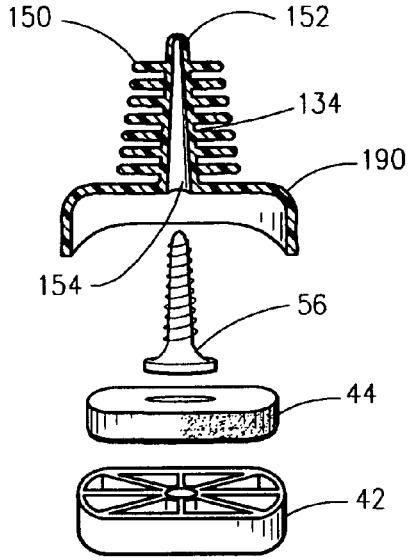
FIG. 10 is an exploded perspective view in partial cross-section of another embodiment of a glide device, similar to that shown in FIG. 9, that has an integrally molded lugged fastener with an expander.

FIG. 9 illustrates a friction fit fastener 50 integrally molded with housing 90. Friction fit fastener 50 includes a shank that extends along an axis "B". Friction fastener 50 would be maintained in mounting cavity 13 with friction between surface 52 and the inside surface of mounting cavity 13. Friction fit fastener 50 may also include a cavity 54 extending along the axis "B". Cavity 54 is sized and configured to receive an expander 56. Installing the expander 56 into cavity 54 results in the expansion of shank 52 thereby creating a normal force against the inner surface of mounting cavity 13. This normal force in conjunction with the friction characteristics of the surfaces retains friction fit fastener 50. In this case expander 56 is a common wood screw. The expander could also be a nail or any suitably configured dowel that is slightly larger than cavity 54 such that when inserted in cavity 54 it causes fastener 50 to expand within the mounting cavity 13. It should be understood that friction fit fastener 50 could also incorporate lugs as described above to enhance friction between the fastener and cavity. FIGS. 10 and 11 illustrate a glide device similar to that in FIG. 9, where the mounting fastener 150 is integrally molded with housing 190 and includes lugs 134 disposed on the fastener shank 152. Fastener 150 may also include a cavity 154 for receiving an expander 56.

Figure 12A:
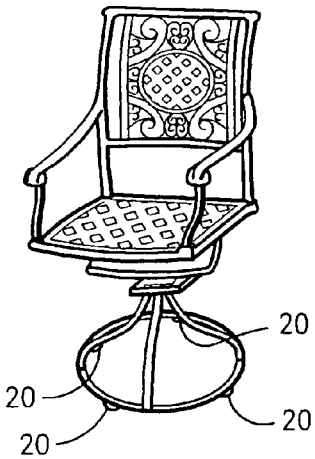
FIG. 12A is a perspective view of an article of cast aluminum patio furniture having a ring base with glide devices, such as shown in FIG. 2, disposed around the ring base.
Figure 12B:
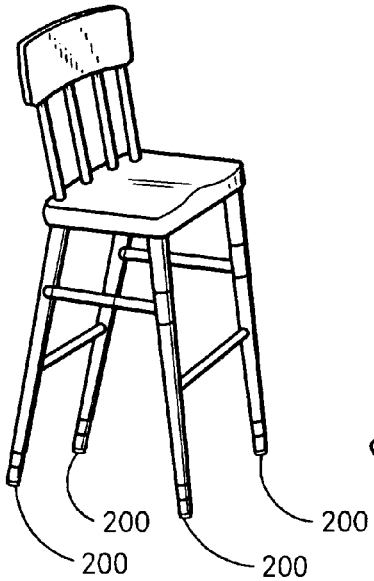
FIG. 12B is a perspective view of wooden barstool having a plurality of legs each with a glide device, such as shown in FIG. 3, disposed thereon.
Figure 12C:
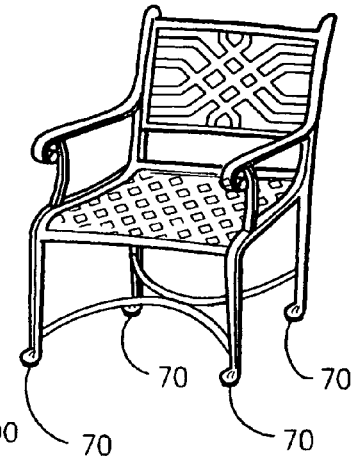
FIG. 12C is a perspective view of an article of aluminum patio furniture having a plurality of legs each with a glide device, such as shown in FIG. 5B, disposed thereon.
Figure 13:
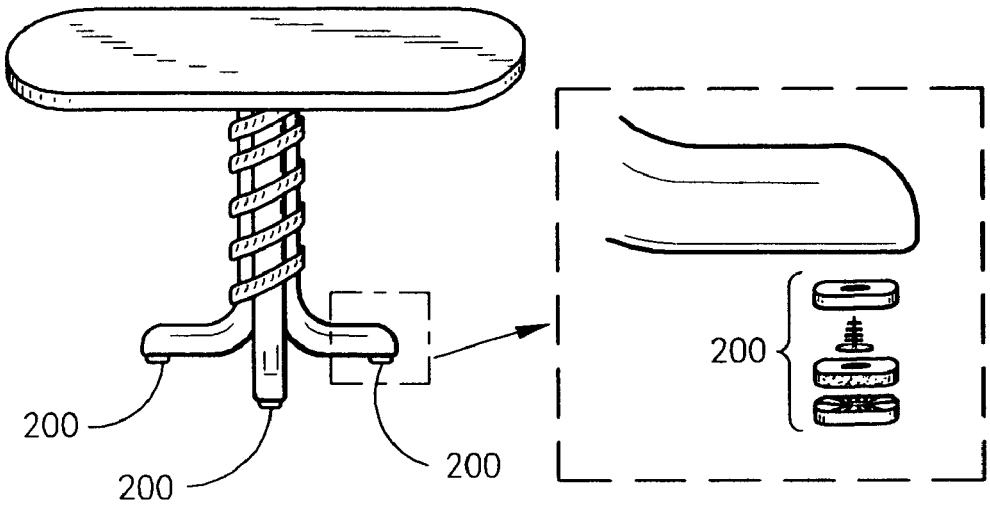
FIG. 13 is a perspective view of a table having a pedestal support and a four-arm foot portion, where each foot portion includes a glide device as shown in FIG. 3.

The above embodiments contemplate retrofitting existing articles of furniture. However all of the embodiments described are applicable to original equipment furniture as well. FIGS. 12A through 12C illustrate some examples of such furniture. These figures are examples only and are not intended to be limiting. It should be understood that the disclosed glide devices can be used on varying types of furniture and objects whether they include legs or otherwise. FIG. 12A depicts a common type of cast aluminum patio furniture with a ring base. Typically this type of patio furniture is manufactured with approximately six mounting cavities that can accommodate a glide device fastener. In this case glide device 20, as shown in FIG. 2, is assembled to the ring base. FIG. 12B illustrates an example of a wooden barstool with a plurality of legs. Often the legs of this type of stool will have a mounting cavity drilled in the end of the leg. Also, if a cavity is not already present in an article of furniture or object, a cavity may be formed therein by drilling. In this case the barstool is fitted with the glide device 200 shown in FIG. 3. FIG. 12C illustrates a class of patio furniture that is manufactured with cast aluminum and also has threaded mounting cavities. These threads are usually ¼-20 UNC, 5/16-18 UNC, M6×1.0, or M8×1.25. As shown, this article of patio furniture is fitted with glide devices 70 as shown in FIG. 5B. Finally, FIG. 13 illustrates a table with a pedestal support and a foot portion consisting of four arms. These arms are usually provided with a threaded mounting cavity that is acceptable to receive a fastener as disclosed herein. In this case a glide device 200, as shown in FIG. 3, is installed on each foot portion.

Figure 14:
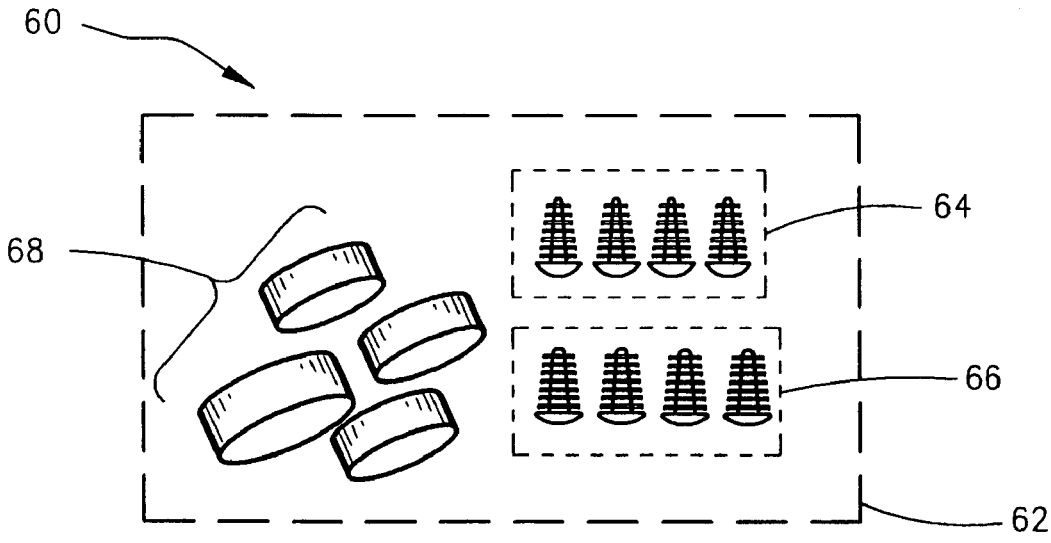
FIG. 14 is an illustration representing an exemplary embodiment of a glide device kit.

FIG. 14 shows a glide device kit 60. Included in the kit 60 are a plurality of stabilizers 68, a first plurality of the first configured fasteners 64, and a second plurality of differently configured fasteners 66. The stabilizers and the fasteners are all contained in a kit package 62. The artisan will realize that any of the stabilizer embodiments described herein could be included in the kit. For instance, the glide device stabilizer shown in FIG. 3, which includes housing 40, body 42, and resilient member 44, could be included in the kit. The first configuration of fasteners may be of a different size than the second. For example, the first set may be sized to fit ¼-20 UNC and M6×1.0 thread sizes. The second set could be sized to fit 5/16-18 UNC and M8×1.25 thread sizes. Suitable fasteners are available from ITWFASTEX®. For instance, ITWFASTEX® part numbers 354-200101-00 and 2601-00 are suitable for either a ¼-20 UNC thread or a 3/16" diameter smooth bore. When mounting to a 5/16-18 UNC thread or a ¼" diameter smooth bore, ITWFASTEX® part numbers 36063009 and 39065005 are suitable fasteners. One or the other of these sets may include fasteners of an alternate configuration such as wood screws or nails.

A method is also contemplated for stabilizing an object against a contact surface where the object has a mounting portion provided with a mounting cavity that extends axially into the mounting portion of the object. This method may include any steps inherent in any of the disclosed embodiments. Broadly, the method includes the step of providing a glide device that includes a stabilizer and a fastener for mounting the glide device to a mounting portion by axially urging the shank of the fastener into the mounting cavity until the lug engages an inner surface of the mounting cavity thereby providing traction against the inner surface to resist removal of the stabilizer from the foot portion.

Accordingly, the present invention has been described with some degree of particularity directed to certain exemplary embodiments. Those of skill in the art, though, will recognize that certain modifications, permutations, additions and subcombinations thereof are within the true spirit and scope of the various embodiments.

I claim:

1. A glide device adapted to be mounted between a contact surface and an object, comprising:

a. a stabilizer including a housing mountable to the object, a body insert configured to be at least partially received within said housing, and a resilient member for interfacing said body insert to said housing, said resilient member having an associated upper surface for engaging said housing and an associated lower surface for engaging said unitary body, said upper and lower surfaces each including a layer of adhesive for respectively interfacing said resilient member between said housing and said body; and b. a fastener for mounting said housing to the object, wherein said resilient member separates said fastener and said body insert when in an assembled state, said fastener including an elongate shank and at least one lug projecting away from said shank.

2. A glide device according to claim 1 wherein said housing and said fastener are of molded plastic construction.

3. A glide device according to claim 2 wherein said housing and said fastener are integrally molded.

4. A glide device according to claim 1 wherein said housing includes an opening through which said shank extends.

5. A glide device according to claim 1 wherein said resilient member includes first and second opposed surfaces with a surrounding sidewall extending therebetween, wherein said sidewall is in close confronting relation with an inner sidewall of said housing.

6. A glide device, comprising:

a. a stabilizer including a housing mountable to an object, a body configured to be at least partially received within said housing in an assembled state, and a resilient member for interfacing said body to said housing to define the assembled state; and b. a fastener for mounting said housing to the object, said fastener being of unitary construction and including an elongate shank that extends along a shank axis through an opening formed in said housing, said fastener being sized for insertion into a mounting cavity formed in the object and including a plurality of lugs disposed about said shank which, upon insertion, provide traction against an inner surface of the mounting cavity to resist subsequent removal of said housing from the object, said lugs configured as fins that are equiangularly spaced about said shank axis and disposed about said shank in axially spaced relation to one another.

7. A glide device according to claim 6 wherein said lugs are each annular in configuration and are disposed about said shank in axially spaced relation to one another.

8. An article of furniture, comprising:

a. a working surface;

b. a plurality of legs each extending downwardly from said working surface and having a foot portion provided with a uniform cylindrical mounting cavity;

c. a glide device associated with each said foot portion, each said glide device comprising:

i. a stabilizer including a housing mounted to its respective foot portion, a body at least partially received within said housing, and a resilient member interfacing said body to said housing; and ii. a fastener mounting said stabilizer to its respective said foot portion, wherein said resilient member separates said fastener and said body, said fastener including a shank portion extending upward from the housing and a plurality of lugs disposed along said shank portion in axially spaced relation to one another and projecting away from said shank portion, said lugs engaging an inner surface of said mounting cavity and providing traction against said inner surface to resist subsequent removal of said stabilizer from said foot portion.

9. An article of furniture according to claim 8, wherein said article of furniture has a configuration selected from the group consisting of a chair, a table, and a bar stool.

10. An article of furniture according to claim 9 wherein said foot portion is constructed of cast metal.

11. In an article of furniture including a plurality of legs each having an associated foot portion and a stabilizer fastened thereto by a fastener that includes a shank extending into a uniform cylindrical mounting cavity formed in the foot portion, the improvement comprising a plurality of lugs axially spaced relative to each other that are formed integrally with said shank and project away from said shank to provide traction against an inner surface of the mounting cavity to resist subsequent removal of said stabilizer from the foot portion, and wherein said stabilizer comprises a housing mounted to its associated said foot portion, a unitary body at least partially received within said housing, and a resilient member interfacing said unitary body to said housing, said resilient member including first and second opposed surfaces with a surrounding sidewall extending therebetween, wherein said sidewall is in close confronting relation with an inner sidewall of said housing.

12. The improvement of claim 11 wherein said lugs are each annular in configuration and are disposed about said shank in axially spaced relation to one another.

13. The improvement of claim 11 wherein said fastener is of molded plastic construction.

14. A glide device kit for use with an object that is to be stabilized against a contact surface, wherein said object has at least one mounting cavity, said glide device kit comprising:

a. at least one stabilizer interposable in a mounted state between the object and the contact surface, said stabilizer including a housing mountable to the object, a unitary body configured to be at least partially received within said housing, and a resilient member for interfacing said body to said housing to define an assembled state; and b. a plurality of differently configured fasteners each for mounting an associated said housing to the object, each of said fasteners insertable through at least a portion of said housing and a correspondingly sized said mounting cavity in order to mount said stabilizer to the object to define the mounted state, wherein said resilient member separates said fastener and said body, and wherein at least one of said fasteners includes a shank extending along a shank axis and a lug projecting away from said shank which is adapted, upon insertion into its associated mounting cavity, to provide traction against an inner surface of the mounting cavity to resist subsequent removal of said stabilizer from the object.

15. A glide device kit according to claim 14 wherein said at least one of said fasteners includes a plurality of lugs disposed along said shank in axially spaced relation to one another.

16. A glide device, comprising:

a. a stabilizer interposable between an object and a contact surface, wherein said stabilizer includes a housing mountable to the object, a body configured to be at least partially received within said housing and in facing relationship with said contact surface, and a resilient member for interfacing said body to said housing in an assembled state; and b. a friction fit fastener for mounting said housing to the object, wherein said resilient member separates said fastener and said body, said fastener including an elongate shank extending from said housing which is sized for insertion into a mounting cavity formed in the object, said shank extending along a shank axis and including a cavity extending along the axis that is sized and configured to receive an expander whereby assembling said expander into said cavity results in an expansion of said shank thereby providing traction against an inner surface of the mounting cavity to resist subsequent removal of said housing from the object.

17. A glide device according to claim 16 wherein said resilient member includes first and second opposed surfaces with a surrounding sidewall extending therebetween, wherein said sidewall is in close confronting relation with an inner sidewall of said housing.

* * * * *